US005890647A

United States Patent [19]

Petkovsek

[11] Patent Number: 5,890,647

[45] **Date of Patent: *Apr. 6, 1999**

[54] SPECIAL SERVICE MAIL ASSEMBLY WITH INTEGRALLY FORMED RETURN ENVELOPE AND A METHOD FOR ASSEMBLING A MAILPIECE REQUIRING DELIVERY BY A SPECIAL SERVICE

[76] Inventor: Glenn Petkovsek, 20 Tortoise Park Cove, Little Rock, Ak. 72211-2349

[ * ] Notice: This patent issued on a continued prosecution application filed under 37 CFR 1.53(d), and is subject to the twenty year patent term provisions of 35 U.S.C. 154(a)(2).

[21] Appl. No.: 757,852

[22] Filed: Nov. 27, 1996

[51] Int. Cl.[6] ..... B65D 27/06

[52] U.S. Cl. ..... 229/92.1; 229/92.8; 229/301

[58] Field of Search ..... 229/300, 301, 229/92.1, 92.8

[56] References Cited

U.S. PATENT DOCUMENTS

| | | | |
|---|---|---|---|
| 2,279,164 | 4/1942 | Gettleman . | |
| 2,328,380 | 8/1943 | Feder | 229/300 |
| 2,983,431 | 5/1961 | Turan . | |
| 2,985,464 | 5/1961 | McFarland . | |
| 3,406,894 | 10/1968 | Settle . | |
| 3,807,771 | 4/1974 | Greason | 229/300 X |
| 3,837,565 | 9/1974 | Johnsen . | |
| 3,937,492 | 2/1976 | Biron . | |
| 4,682,793 | 7/1987 | Walz . | |
| 4,724,996 | 2/1988 | Everett | 229/301 |
| 4,951,864 | 8/1990 | Dicker . | |
| 5,169,060 | 12/1992 | Tighe et al. | 229/301 |
| 5,183,203 | 2/1993 | Sanders . | |
| 5,340,017 | 8/1994 | Tighe | 229/300 |
| 5,360,160 | 11/1994 | Sauerwine et al. | 229/300 X |
| 5,421,620 | 6/1995 | Sauerwine | 229/301 X |
| 5,553,774 | 9/1996 | Goodno . | |
| 5,626,286 | 5/1997 | Petkovsek | 229/300 |

FOREIGN PATENT DOCUMENTS

| | | |
|---|---|---|
| 2.225.000 | 10/1974 | France . |

*Primary Examiner*—Jes F. Pascua

*Attorney, Agent, or Firm*—Brian M. Mattson; Patents + TMS

[57] ABSTRACT

A system and a method for mailing a mailpiece requiring special service delivery is provided as well as a mailpiece that requires delivery by a special service. The assembled mailpiece includes a return postcard and a return envelope independently detachable from a remainder of the mailpiece. The mailpiece may be printed with information to be sent to an addressee by a sender. The sender may receive a return postcard verifying delivery of the mailpiece, and the sender, or another individual, may also receive a remittance in the return envelope also independently detachable from the assembled mailpiece. The assembled mailpiece is formed from a single sheet that may be printed with variable information on both sides of the sheet. The information may relate to the mail handling or to other information to be sent to the individual. The assembly is particularly suitable for special service delivery of mail including return remittance of payment or the like.

17 Claims, 4 Drawing Sheets

SPECIAL SERVICE MAIL ASSEMBLY WITH INTEGRALLY FORMED RETURN ENVELOPE AND A METHOD FOR ASSEMBLING A MAILPIECE REQUIRING DELIVERY BY A SPECIAL SERVICE

BACKGROUND OF THE INVENTION

The present invention generally relates to an assembly for mailing a mailpiece requiring delivery by a special service as well as a method for assembling a mailpiece and a mailpiece requiring delivery by a special service. The present invention is more specifically related to a mailpiece requiring special service delivery that further requires a return envelope for remittance to the sender of the mailpiece.

It is, of course, generally known to send mailpieces requiring special services. Such services include certified mail, insured mail, registered mail, return receipt for merchandise, and the like. To this end, an envelope is typically provided in which an article is inserted for special delivery of the article. Separately, a return postcard is completed for attachment to the mailpiece and, upon delivery of the mailpiece, the return postcard is removed from the envelope and returned to the sender to verify delivery.

Often, in addition to confirmation that the mailpiece was delivered, a remittance is required.

Typically, the remittance is in the form of a payment, but may also be, for example, a return form, a survey or the like. To return such a remittance, a return envelope is often provided with the mailing. The return envelope is typically provided in the envelope in which the mailpiece is sent.

Further, mailpieces often require printed information regarding the addressee, the sender, as well as information being sent to the addressee. All of the information that requires printing requires separate passes of each component, i.e. the envelope, the return postcard and/or the return envelope, through a printing device. Following printing of the information, each of the components must then be re-assembled with their corresponding parts prior to mailing of the mailpiece.

A need, therefore, exists for an improved mailpiece, an assembly for mailing a mailpiece, and a method for assembling a mailpiece requiring delivery by a special service that overcomes the deficiencies of known assemblies.

SUMMARY OF THE INVENTION

The present invention provides an assembly, a method for mailing a mailpiece requiring delivery by special service as well as a mailpiece requiring delivery by a special service. The mailpiece includes a single sheet having a return postcard and a return envelope integrally formed therewith. After folding and sealing the single sheet, and also following printing required information on the single sheet, the mailpiece is ready for delivery. In addition, the mailpiece provides a simplified structure in which the return postcard and the return envelope may be removed from a remainder of the mailpiece, and a message printed on the mailpiece may be read.

In an embodiment of the present invention, an assembly is provided for mailing a mailpiece requiring special services. The assembly has a single sheet having a front side and a back side capable of receiving printed information on each of the front side and the back side. A portion of each of the front side and the back side includes a return postcard. Another portion of the single sheet, after folding, forms a return envelope wherein each of the return postcard and the return envelope is independently detachable from a remainder of the single sheet.

In an embodiment, perforated tear lines separate the return postcard from the single sheet.

In an embodiment, a perforated tear line separates the return envelope from the single sheet.

In an embodiment, adhesive areas on the back side of the single sheet secure adjacent sections of the single sheet after folding.

In an embodiment, a message area on the single sheet is separable from the return postcard and the return envelope.

In an embodiment, the message area on the single sheet is capable of receiving information on the front side and the back side.

In an embodiment, perforated tear lines are provided around a portion of a remainder of the single sheet after removal of the return postcard and the return envelope.

In an embodiment, an article identifier is provided on the return postcard and the single sheet.

In an embodiment, a special services identifier is provided on the single sheet.

In another embodiment of the present invention, a method for assembling a mailpiece requiring delivery by a special service is provided. The method comprises the steps of: providing a single sheet having a front side and a back side capable of receiving printed information on each of the front side and the back side wherein a portion of each of the front side and the back side includes a return postcard; folding the single sheet along a first fold line enclosing a message area; and folding the single sheet along a second fold line forming a return envelope separable from the message area.

In an embodiment, the return postcard is separated from the single sheet along a perforated tear line between the single sheet and the return postcard.

In an embodiment, an adhesive area is provided on the back side of the single sheet that secures the enclosed message area after folding along the first fold line.

In an embodiment, an adhesive area is provided on the back side of the single sheet that secures the return envelope after folding the single sheet forming an interior compartment in the return envelope.

In an embodiment, the return envelope is separated from the single sheet along a perforated tear line between the single sheet and the return envelope.

In an embodiment, an identifier is provided on the single sheet indicative of the special service required for the mailpiece.

In another embodiment of the present invention, a mailpiece requiring special service delivery is provided. The mailpiece has a document section having a message area with a front side and a back side on which information may be printed. A return envelope is integrally formed with the document section. A first perforated tear line between the document section and the return envelope allows independent removal of the return envelope from the document section. A return postcard is integrally formed with the document section. A second perforated tear line is between the document section and the return postcard allowing independent removal of the return postcard from the document section.

In an embodiment, a special services identifier is provided on the document section indicative of a special service required.

In an embodiment, the document section, the message area, the return postcard and the return envelope include areas that receive variable printed information.

In an embodiment, a perforated tear line separates the document section from the message area.

In an embodiment, an article identifier is provided on the document section and the return postcard.

It is, therefore, an advantage of the present invention to provide an assembly, a method for assembling a mailpiece and a mailpiece requiring special services that simplifies preparation of the same.

Another advantage of the present invention is to provide an assembly, a method for assembling a mailpiece and a mailpiece requiring special services from a single sheet.

A still further advantage of the present invention is to provide an assembly, a method for assembling a mailpiece and a mailpiece requiring special services that simplifies remittance of payment or other remittance by an addressee.

Yet another advantage invention is to provide an assembly, a method for assembling a mailpiece, and a mailpiece requiring special services that may be simply and variably printed.

Moreover, an advantage of the present invention is to provide an assembly, a method for assembling a mailpiece and a mailpiece requiring special services that may be simply separated by the addressee into its component parts.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention provides an assembly for mailing a mailpiece requiring delivery by a special service as well as a method for assembling a mailpiece requiring delivery by a special service as well as the mailpiece requiring delivery by special service. The mailpiece is constructed from a single sheet that, after folding and sealing, forms a mailpiece that includes a return postcard and return envelope.

Figure 1:
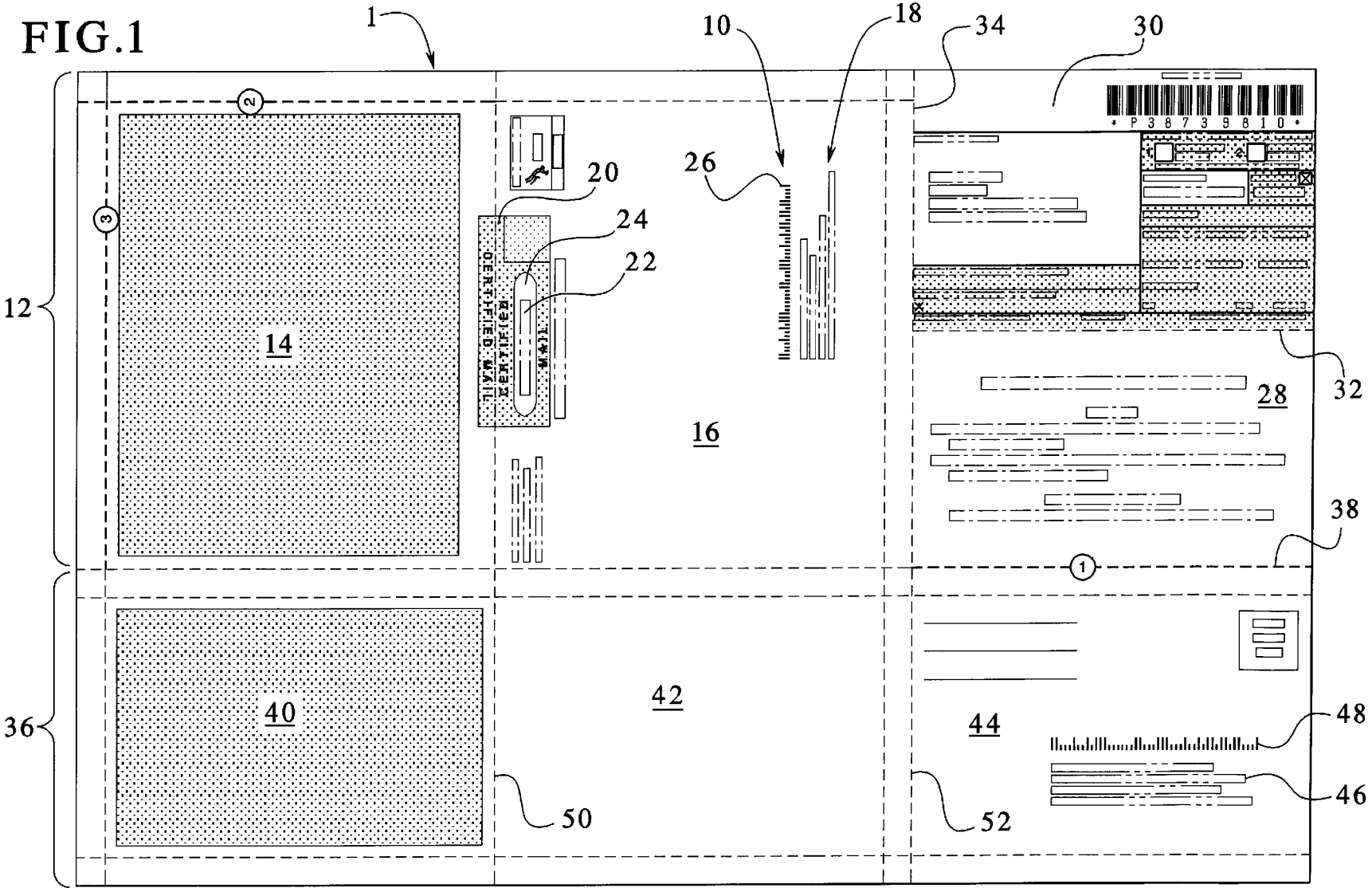
FIG. 1 illustrates a plan view of a front side of an embodiment of a single sheet special service mailpiece.

Referring now to the drawings wherein like numerals refer to like parts, FIG. 1 illustrates a single sheet 1 that, following folding and sealing thereof, forms a mailpiece that includes a return postcard and a return envelope. A front side 10 of the sheet 1 is shown in FIG. 1 including multiple parts. A top portion 12 includes a first area 14 on which a message can be printed. Further, a second area 16 is provided on which information 18 relating to an addressee may be printed. An identifier 20 may also be placed in the area 16 and overlap into the first area 14 that identifies the type of special service required for delivery of the mailpiece, in this case, certified mail. An article identification number 22 is provided in a windowed area 24 of the identifier 20. In addition, a machine readable code 26 may be printed adjacent the information 18 related to the addressee. The article identification number 22 may also, as well, be machine readable.

A third area 28 is provided in the top portion 12 of the sheet 1. The third area 28 includes a return postcard 30 that is separable from a remainder of the sheet by perforated tear lines 32,34.

The single sheet 1 has the top portion 12 divided from a bottom portion 36 by a perforated tear line 38. The bottom portion 36 includes a first area 40 on which information may be printed. A second area 42 is provided that forms a back side of an envelope following folding and sealing of the same. A third area 44 is provided on which information 46 may be pre-printed relating to whom the remittance is being sent. A machine readable code 48 may also be provided immediately above the information 46. Lines 50,52 designate points at which the sheet 1 is folded to form the assembly illustrated in FIG. 5.

Figure 2:
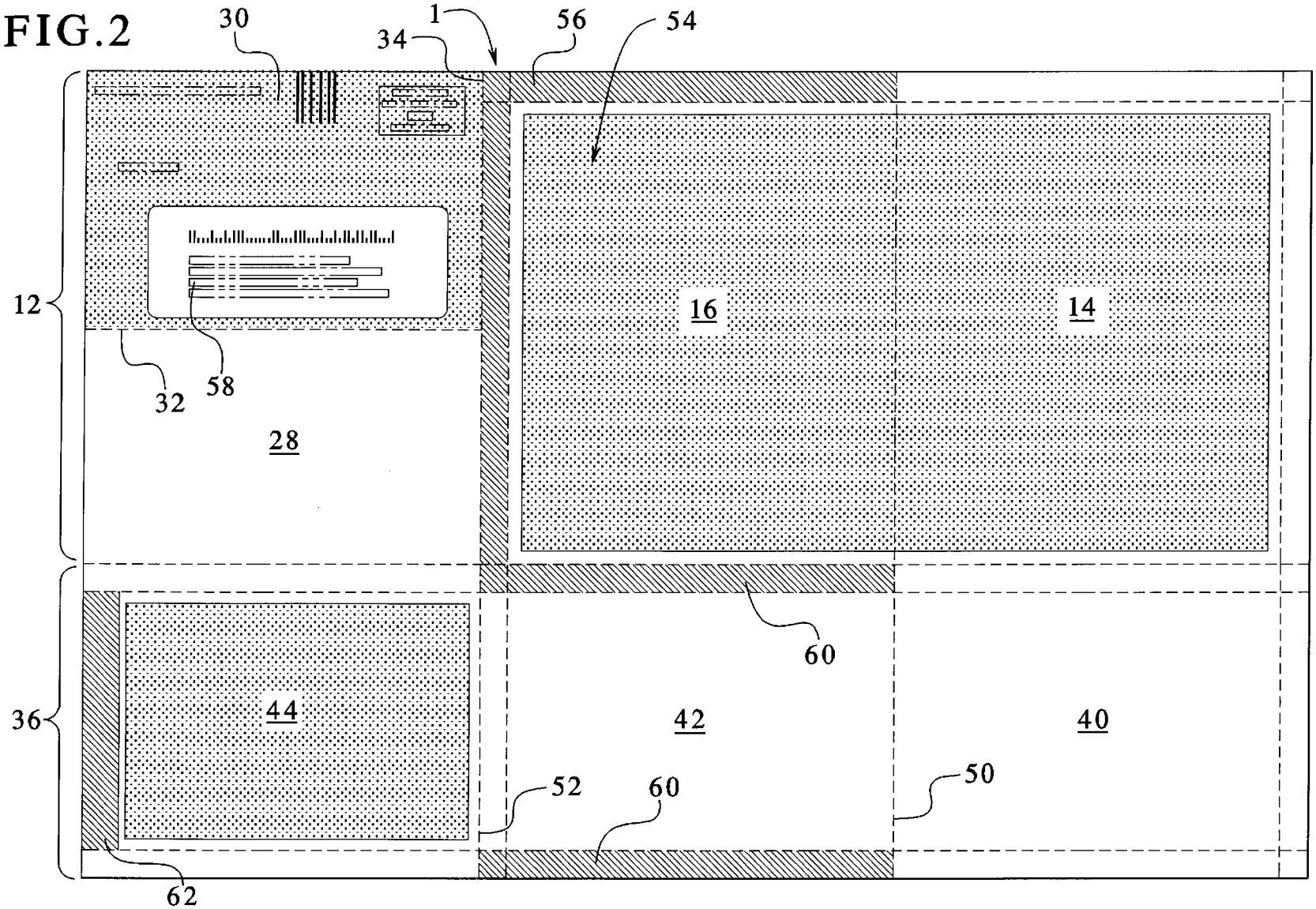
FIG. 2 illustrates a plan view of a back side of an embodiment of a single sheet special service mailpiece.

Referring now to FIG. 2, a back side 54 of the sheet 1 is illustrated. The back side 54 is opposite the front side and includes the top portion 12 and the bottom portion 36. A reverse side of the first and second areas 14,16 includes space on which information may be printed. Further, in the second area 16, adhesive areas 56 are provided for securing specific portions of the mailpiece after folding the sheet 1. In the third area 28, a reverse side of the return postcard 30 is shown. Sender address information 58 may be printed or pre-printed on the return postcard 30 in the area indicated in FIG. 2. The perforated tear lines 32,34 allow for selective removal of the return postcard 30 following receipt of the mailpiece.

The bottom portion 36 of the sheet 1 includes two areas 40,42 which, after forming the mail assembly, form an interior compartment or pocket of the return envelope. To this end, adhesive areas 60 are provided such that when the area 40 is folded onto the area 42 at the fold line 50, the areas adhere one onto the other forming the interior compartment. Likewise, the area 44 includes an area on which information may be printed and an adhesive area 62 that completes formation of the return envelope when assembled as shown in FIGS. 3–5.

Figure 3:
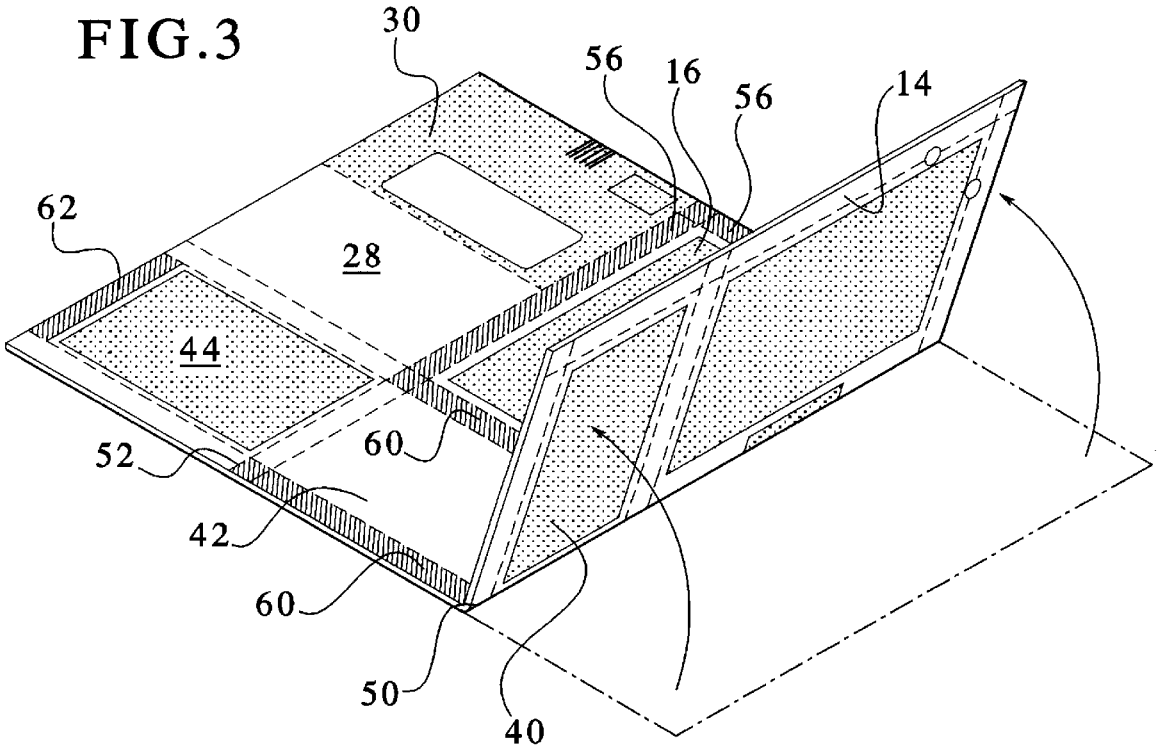
FIG. 3 illustrates a perspective view of an embodiment of a single sheet mailpiece during a first step of assembly thereof.
Figure 4:
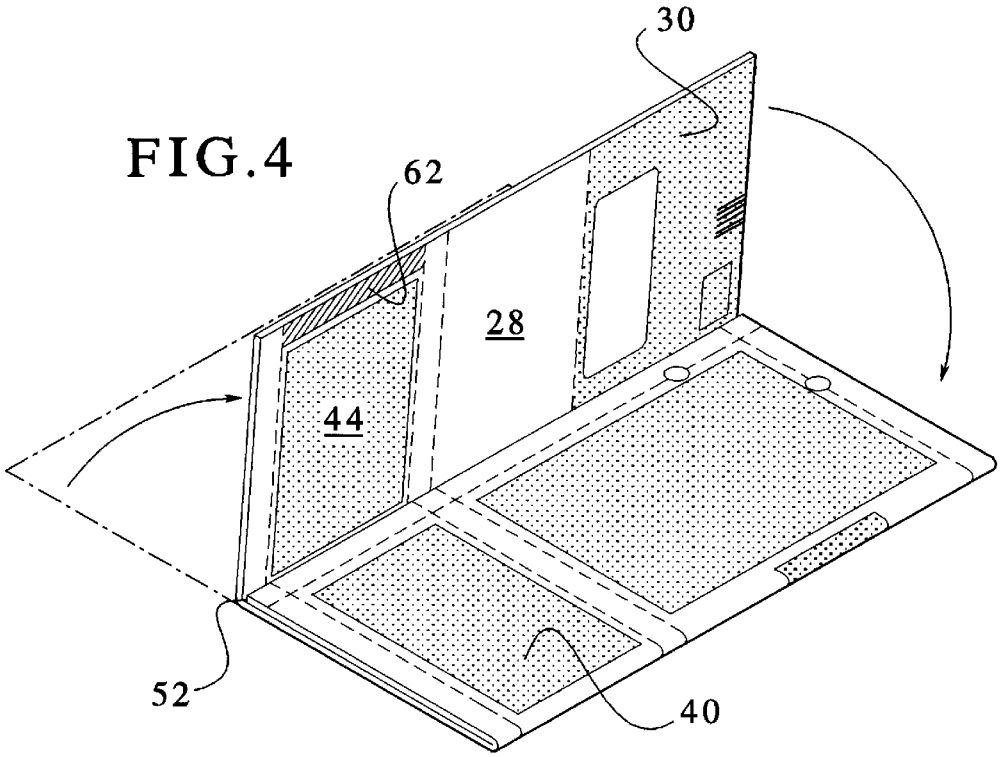
FIG. 4 illustrates a perspective view of an embodiment of a single sheet mailpiece during a second step of assembly thereof.
Figure 5:
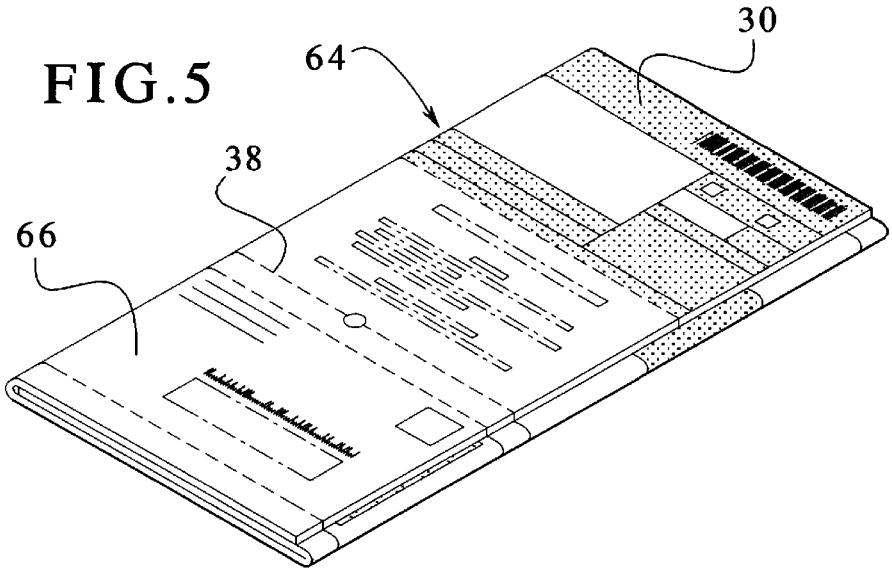
FIG. 5 illustrates a perspective view of an embodiment of an assembled mailpiece constructed from a single sheet.

Referring now to FIGS. 3–5, following printing of any desired information onto the front side 10 or the back side 54 of the sheet 1, the sheet 1 may be assembled as illustrated in FIG. 3 by first folding at the fold line 50. As a result, the areas 14 and 40 are folded onto areas 16 and 42, respectively, on the back side 54 of the sheet 1. The adhesive areas 56,60 may be dry gum or glue seals or any other known adhesive that provides simplified assembly of the mailpiece. After completion of the fold, the areas 28,44 are folded at the fold line 52 as illustrated in FIG. 4. The adhesive area 62 in the area 44 secures to the front side of the area 40 forming the return envelope for remittance.

Figure 6:
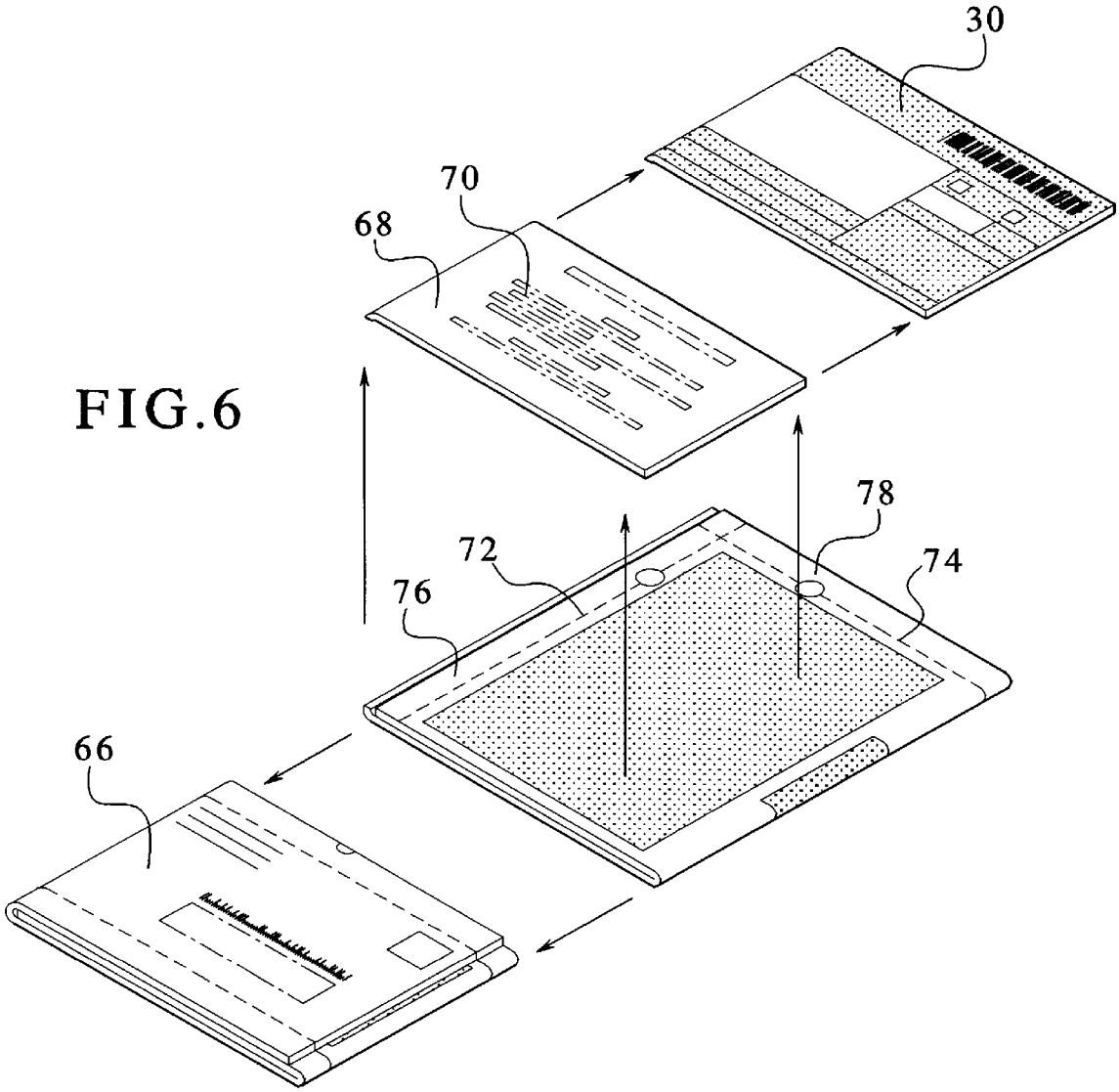
FIG. 6 illustrates a perspective view of an embodiment of a mailpiece following detachment of components of the mailpiece following delivery thereof.

Following folding and sealing, a resultant mailpiece 64 is formed as shown in FIG. 5. The assembled mailpiece 64 includes the return postcard 30 detachable from a remainder of the mailpiece 64 as illustrated in FIG. 6. A return envelope 66 formed by folding and adhering the areas 40,42 and 44 may be removed from the mailpiece 64 as illustrated in FIG. 6 by separation at the perforated tear lines 38. A section 68 may also be provided including instructions 70 for disassembling the mailpiece 64 after receipt by the addressee.

The instruction section 68 may also be removed revealing perforated tear lines 72,74. Following detachment of areas 76,78 at the perforated tear lines 72,74, respectively, areas in which a message is printed may be revealed in the areas 14,16 on the back side 54 of the single sheet 1. Information may also be printed in the area 14 on the front side of the single sheet 1 which is exposed following removal of the return postcard 30 and the section 68 including the instructions 70.

Although the present invention has been shown and described with reference to certified mail, it should be understood that any type of special service mailing may be implemented by those skilled in the art, such as, but not limited to, insured mail, registered mail, return receipt for merchandise, and the like. Further, the manner in which the sheet 1 of the present invention is printed may be implemented by those skilled in the art. Although it is envisioned that an automatic printing device will be implemented, such as a laser printer, thermal printer or the like, it should be appreciated that the sheet may be preprinted with addresses, particularly return addresses for large scale orders, or the sheets may be individually printed by hand. Still further, the sheets may be individually formed and fed to a printer, or alternatively, the sheets may be integrally and continuously formed. Although the described embodiments illustrate specific adhesive areas, alternatively, an adhesive may be added at the time of folding at or near the adhesive areas.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. An assembly for mailing a mailpiece requiring delivery by a special service, the assembly comprising:

a single, rectangular sheet having a front side and a back side defined between top and bottom edges and first and second side edges, the sheet capable of receiving printed information on each of the front side and the back side wherein the single, rectangular sheet is divided into three integrally formed, defined sections wherein the three sections are of equal width between the first and second side edges wherein the first section includes a return postcard in a first portion of the first section and further includes a first side of a return envelope in another portion of the first section and a second side of the return envelope in a second section wherein the first section is adjacent the second section and further wherein a portion of the back side of the second section includes an adhesive area and still further wherein the return postcard is a single lever of the sheet and is detachable from the first section by perforated tear lines defining two sides of the return postcard.

2. The assembly of claim 1 further comprising:

lines of separation between the first section and the second section separating the return postcard from the single sheet.

3. The assembly of claim 1 further comprising:

a line of separation separating the return envelope from the single sheet.

4. The assembly of claim 1 further comprising:

a message area in the second section of the single sheet.

5. The assembly of claim 1 further comprising:

a message area on the single sheet in the second section and a third section.

6. The assembly of claim 1 further comprising:

lines of separation extending across the second section and a third section of the single sheet.

7. The assembly of claim 1 further comprising:

an article identifier on the return postcard and the single sheet.

8. The assembly of claim 1 further comprising:

a special services identifier on the single sheet.

9. A method for assembling a mailpiece requiring delivery by a special service, the method comprising the steps of:

providing a single, rectangular sheet having a front side and a back side capable of receiving printed information on each of the front side and the back side wherein a portion of the single, rectangular sheet includes a return postcard wherein the single, rectangular sheet is formed by three integrally formed, substantially equally sized sections of equal width between the first and second side edges that are integrally formed wherein the return postcard is in the first section and still further wherein the return postcard is a single layer of the sheet and is detachable from the first section by perforated tear lines defining two sides of the return postcard;

folding the single, rectangular sheet along a first fold line enclosing a message area;

folding the single, rectangular sheet along a second fold line forming a return envelope separable from the message area wherein the return envelope is in the first section and in the second section wherein the first section is adjacent the second section; and providing an adhesive area on the back side of the single sheet.

10. The method of claim 9 further comprising the step of:

separating the return postcard from the single sheet along a tear line between the single sheet and the return postcard.

11. The method of claim 9 further comprising the step of:

separating the return envelope from the single sheet along a tear line between the single sheet and the return envelope.

12. The method of claim 9 further comprising the step of:

providing an identifier on the single sheet indicative of the special service required for delivery of the mailpiece.

13. A mailpiece requiring delivery by a special service, the mailpiece comprising:

a document section having a front side and a back side defined between top and bottom edges and first and second side edges wherein the document section is substantially equally divided into a first section, a second section and a third section wherein each of the sections is of equal width;

a return envelope integrally formed with the document section in the first section and in the second section wherein the first section is adjacent the second section;

a first perforated tear line extending entirely across the first section, the second section and the third section between the top and bottom edges at a point intermediate the first and second edges wherein the point divides the document section from the return envelope allowing independent removal of the return envelope from the document section;

a return postcard integrally formed with the document section in the first section wherein the return postcard is a single layer and is constructed without an adhesive;

a second perforated tear line between the first section and the second section extending entirely between the first and second edges allowing independent removal of the return postcard from the document section; and an adhesive area on the back side of the second section.

14. The mailpiece of claim 13 further comprising:

a special services identifier on the document section indicative of a special service required.

15. The mailpiece of claim 1 wherein the document section, the return postcard and the return envelope includes areas that receive variable printed information.

16. The mailpiece of claim 13 further comprising:

tear lines in the second section and in the third section wherein the tear lines are perpendicularly oriented with respect to each other.

17. The mailpiece of claim 13 further comprising:

an article identifier on the document section and the return postcard.

* * * * *